US007905817B2

(12) United States Patent
Giannascoli et al.

(10) Patent No.: US 7,905,817 B2
(45) Date of Patent: Mar. 15, 2011

(54) ADJUSTABLE STATIONARY BICYCLE

(75) Inventors: Antonio Giannascoli, St. Léonard (CA); Eric St-Amant, Montréal (CA); Guy Thibault, Québec (CA)

(73) Assignee: Guru Cycles Inc., Laval (CA)

( * ) Notice: Subject to any disclaimer, the term of this patent is extended or adjusted under 35 U.S.C. 154(b) by 0 days.

(21) Appl. No.: 11/845,986

(22) Filed: Aug. 28, 2007

(65) Prior Publication Data

US 2008/0058170 A1 Mar. 6, 2008

Related U.S. Application Data

(60) Provisional application No. 60/823,777, filed on Aug. 29, 2006, provisional application No. 60/868,433, filed on Dec. 4, 2006.

(51) Int. Cl.

| | |
|---|---|
| ***A63B 22/00*** | (2006.01) |
| ***A63B 71/00*** | (2006.01) |
| ***A63B 22/06*** | (2006.01) |
| ***A63B 69/16*** | (2006.01) |

(52) U.S. Cl. ..... 482/57; 482/51; 482/61

(58) Field of Classification Search ..... 482/57, 482/51–52

See application file for complete search history.

(56) References Cited

U.S. PATENT DOCUMENTS

| | | | | | |
|---|---|---|---|---|---|
| 3,062,204 | A | * | 11/1962 | Stefano | 601/36 |
| 3,750,479 | A | * | 8/1973 | Gause et al. | 73/379.07 |
| 4,637,604 | A | * | 1/1987 | Burt DuPont | 482/148 |
| 4,768,777 | A | * | 9/1988 | Yang | 482/57 |
| 5,035,418 | A | * | 7/1991 | Harabayashi | 482/62 |
| 5,158,515 | A | * | 10/1992 | Cortes Turcios | 482/57 |
| 5,240,417 | A | * | 8/1993 | Smithson et al. | 434/61 |
| 5,312,311 | A | * | 5/1994 | Pearson | 482/57 |
| 5,549,527 | A | * | 8/1996 | Yu | 482/57 |
| 5,782,639 | A | * | 7/1998 | Beal | 434/29 |
| 5,913,752 | A | * | 6/1999 | Bolf | 482/72 |
| 6,066,073 | A | * | 5/2000 | Stearns et al. | 482/4 |
| 6,126,577 | A | * | 10/2000 | Chang | 482/57 |
| 6,251,047 | B1 | * | 6/2001 | Stearns et al. | 482/4 |
| 6,648,802 | B2 | * | 11/2003 | Ware | 482/57 |
| 7,081,070 | B1 | * | 7/2006 | Washington et al. | 482/57 |
| 7,399,259 | B2 | * | 7/2008 | Somwong | 482/57 |
| 7,438,672 | B1 | * | 10/2008 | Rylander et al. | 482/61 |
| 7,481,746 | B2 | * | 1/2009 | Ibarguren | 482/57 |
| 7,641,600 | B2 | * | 1/2010 | Bingham et al. | 482/57 |
| 7,682,286 | B2 | * | 3/2010 | Badarneh et al. | 482/5 |
| 2003/0171190 | A1 | * | 9/2003 | Rice | 482/57 |
| 2004/0053750 | A1 | * | 3/2004 | Forcillo | 482/57 |
| 2004/0176218 | A1 | * | 9/2004 | Fan | 482/57 |
| 2004/0198561 | A1 | * | 10/2004 | Corbalis et al. | 482/57 |
| 2004/0248702 | A1 | * | 12/2004 | Baker | 482/57 |
| 2005/0221960 | A1 | * | 10/2005 | Miyamaru et al. | 482/57 |

(Continued)

*Primary Examiner* — Rinaldi I Rada
*Assistant Examiner* — Robert F Long
(74) *Attorney, Agent, or Firm* — Ogilvy Renault LLP

(57) ABSTRACT

A stationary bicycle comprises a frame. A crankset is rotatably mounted to the frame to receive a pedaling actuation from a user of the stationary bicycle. A seat is mounted to the frame to support the user using the crankset in the pedaling actuation. A handlebar is mounted to the frame to serve as a hand/arm support for the user during the pedaling actuation. Translational joints between the frame and the seat and the handlebar are provided for translational displacement of the seat or handlebar with respect to the crankset. A mechanism is connected to the translational joint for locking the translational joint in a selected position, the mechanism allowing movement of the translational joint solely by a selected actuation displacing the translational joint proportionally in the direction of the translational displacement.

24 Claims, 6 Drawing Sheets

U.S. PATENT DOCUMENTS

2005/0221961 A1* 10/2005 Forcillo ..... 482/57
2006/0003870 A1* 1/2006 Corbalis et al. ..... 482/57
2006/0003872 A1* 1/2006 Chiles et al. ..... 482/57
2006/0105887 A1* 5/2006 Hao ..... 482/57
2006/0172867 A1* 8/2006 Lee ..... 482/57
2006/0199700 A1* 9/2006 LaStayo et al. ..... 482/4
2006/0234836 A1* 10/2006 Kuo ..... 482/57
2006/0234837 A1* 10/2006 Kuo ..... 482/57
2006/0270522 A1* 11/2006 Yonehana et al. ..... 482/8
2007/0003910 A1* 1/2007 Kirila ..... 434/61
2007/0099766 A1* 5/2007 Pyles et al. ..... 482/57
2007/0099767 A1* 5/2007 Harashima ..... 482/57
2007/0105694 A1* 5/2007 Panatta ..... 482/57
2007/0142177 A1* 6/2007 Simms et al. ..... 482/8
2007/0149364 A1* 6/2007 Blau et al. ..... 482/57
2007/0161467 A1* 7/2007 Lee ..... 482/57
2007/0173381 A1* 7/2007 Chen et al. ..... 482/57
2007/0281835 A1* 12/2007 Baker ..... 482/57

* cited by examiner

ADJUSTABLE STATIONARY BICYCLE

CROSS REFERENCE TO RELATED APPLICATIONS

This patent application claims priority on U.S. Provisional Patent Applications No. 60/823,777, filed on Aug. 29, 2006, and No. 60/868,433, filed on Dec. 4, 2006.

FIELD OF THE APPLICATION

The present application relates to stationary bicycles and, more particularly, to an adjustable stationary bicycle as used for exercise, as a fitting apparatus in purchasing a bicycle, and/or as an interface in the gaming industry.

BACKGROUND OF THE ART

In riding a bicycle, the pedaling power of the user is a primary factor in determining how fast the rider will get to the destination. There are other factors associated with the bicycle and the interaction between the rider and the bicycle, such as the wind resistance (i.e., drag coefficient) and the weight.

In order to optimize the power output of the rider on the bicycle, it is important that the bicycle be of appropriate dimensions for the rider. The rider must be in an aerodynamic riding position as much as possible, but the position should affect the breathing and the pedaling of the rider as little as possible. The pedaling power is directly related to the heart rate of the rider, whereby adequate breathing is essential to an optimized riding position.

At present, when purchasing a bicycle, a rider moves onto the bike having its rear wheel supported by a trainer. According to the salesman's experience, various adjustments are made (vertical and horizontal position of the seat, stem length and handlebar height) until a suitable riding position is reached, often as visually decided by the salesman. The rider must at the very least stop pedaling and lean forward to make adjustments to the seat. In some instances, the rider must come off the bicycle for adjustments to be made.

In the indoor training industry and more specifically in gyms, stationary bikes are often limited as to the adjustable parameters that are available for the user. Moreover, a user of the stationary bicycle often lacks the ability or the assistance of a trainer to adjust the bicycle to a proper fit. Therefore, a rider training on a stationary bicycle often does not sit in the optimized riding position, therefore not fully benefiting from the workout.

SUMMARY OF THE APPLICATION

It is therefore an aim of the present invention to provide a novel stationary bicycle that addresses issues associated with the prior art.

Therefore, in accordance with a first embodiment, there is provided a stationary bicycle comprising: a frame; a crankset rotatably mounted to the frame to receive a pedaling actuation from a user of the stationary bicycle; a seat mounted to the frame to support the user using the crankset in the pedaling actuation; a handlebar mounted to the frame to serve as a hand/arm support for the user during the pedaling actuation; at least one translational joint between the frame and at least one of the seat and the handlebar for translational displacement of the seat or handlebar with respect to the crankset; and a mechanism connected to the translational joint for locking the translational joint in a selected position, the mechanism allowing movement of the translational joint solely by a selected actuation displacing the translational joint proportionally in the direction of the translational displacement.

In accordance with a second embodiment, there is provided a stationary bicycle control system in combination with a stationary bicycle, comprising: a stationary bicycle comprising a crankset rotatably mounted to a frame to receive a pedaling actuation from a user of the stationary bicycle, a seat and a handlebar, at least one 1-DOF seat joint between the frame and the seat, and at least one 1-DOF handlebar joint between the frame and the handlebar; a seat actuator to actuate the 1-DOF seat joint to cause displacement of the seat; a handlebar actuator to actuate the 1-DOF handlebar joint to cause displacement of the handlebar; a bicycle controller system comprising: a user interface for entering/adjusting positions for the seat and for the handlebar; a position commander for displacing the seat and the handlebar through actuation of the seat actuator and the handlebar actuator; and a position calculator receiving actuation data from the position commander and calculating a position of the seat and of the handlebar so as to guide the position commander in positioning the seat and the handlebar to selected positions.

In accordance with a third embodiment, there is provided a method for adjusting a stationary bicycle for a user, comprising: providing a stationary bicycle with a seat and a handlebar related to a crankset by actuators; obtaining anthropometric data associated with the user; selecting a seat position and a handlebar position with respect to the crankset for the stationary bicycle, as a function of the anthropometric data associated with the user; and displacing the seat to said selected seat position and the handlebar to said selected handlebar position relative to the crankset by actuating said actuators; whereby the stationary bicycle is adjusted for the user.

DESCRIPTION OF THE PREFERRED EMBODIMENTS

Figure 1:
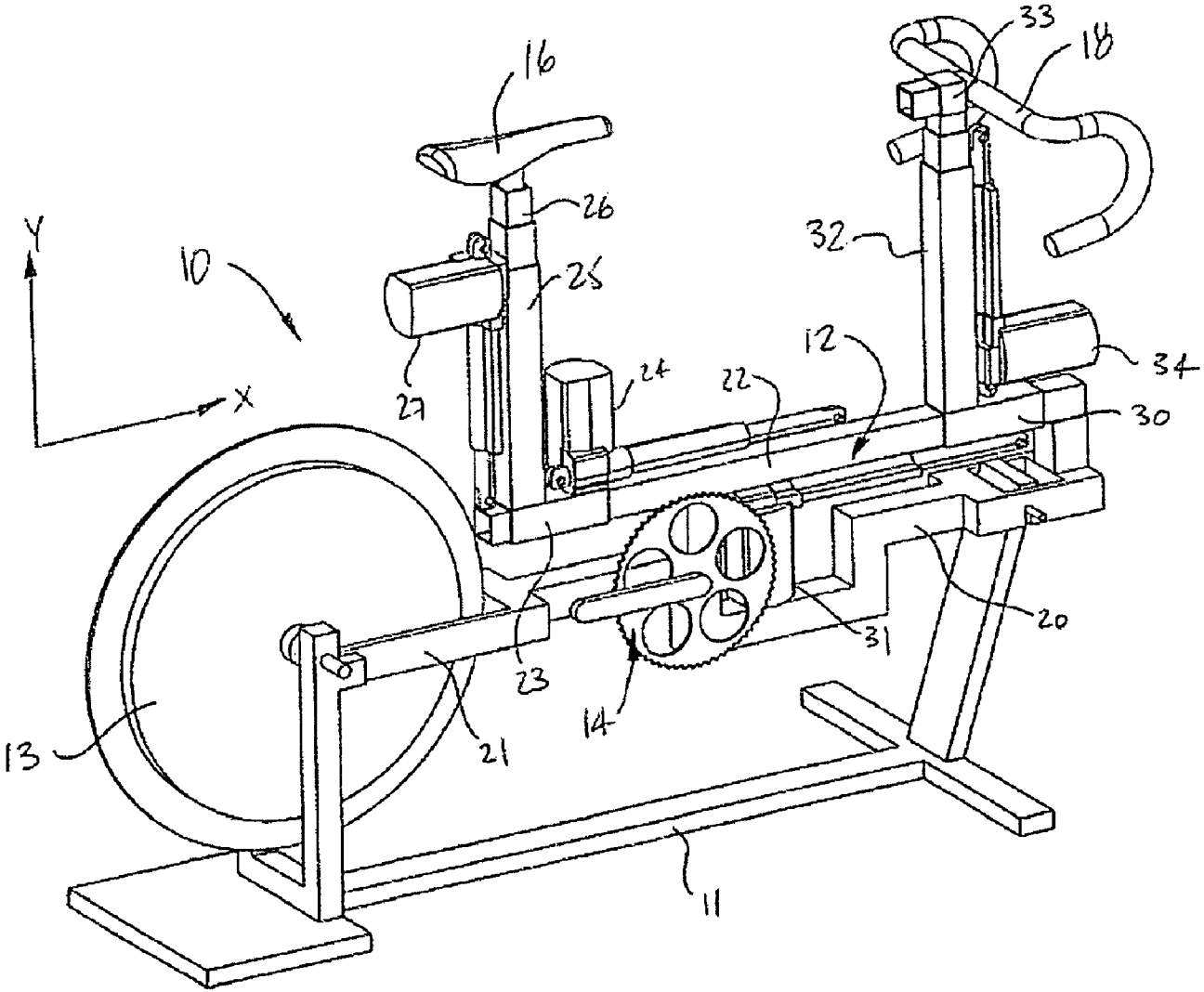
FIG. 1 is a rear perspective view of an adjustable stationary bicycle in accordance with an embodiment of the present invention.
Figure 2:
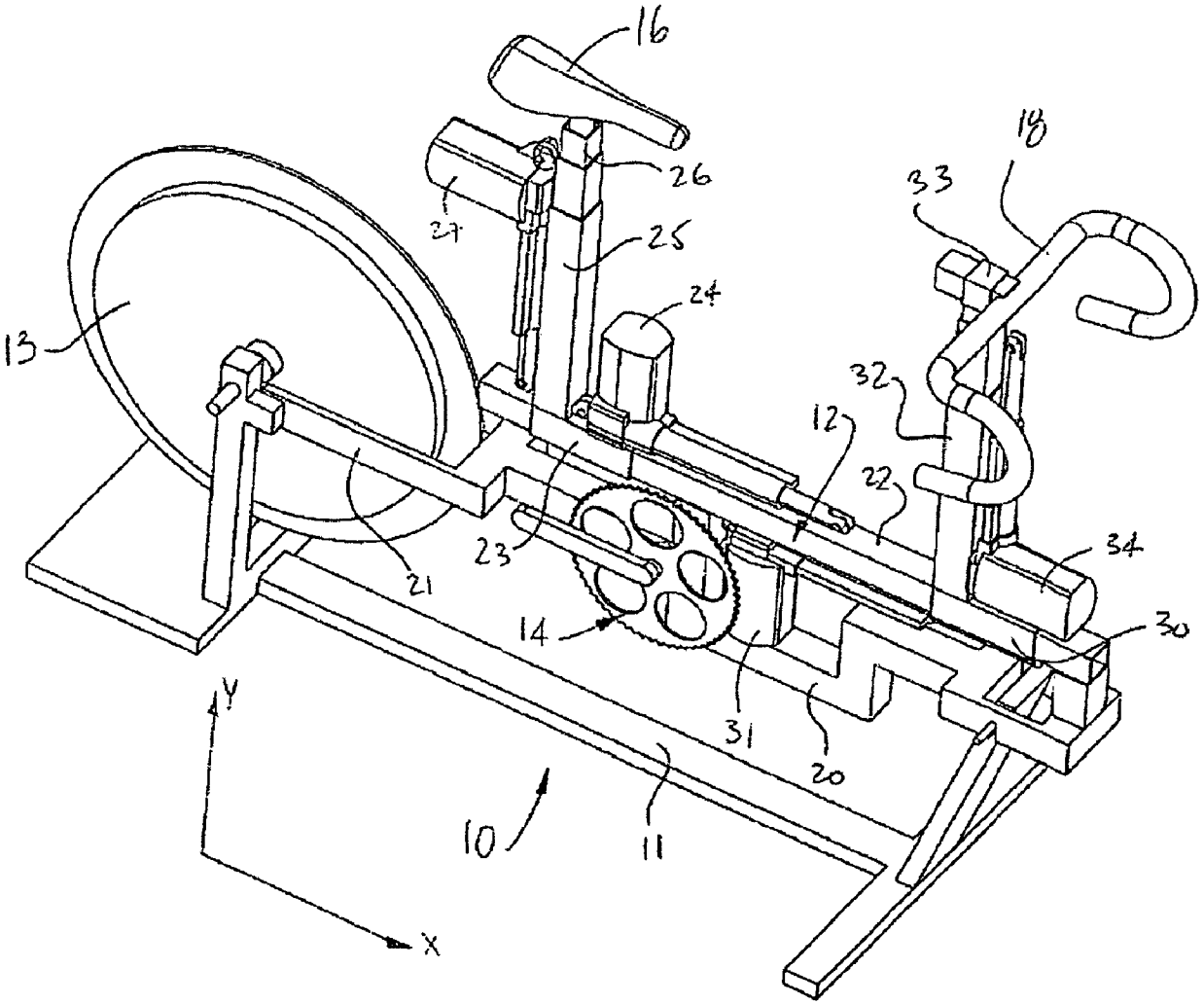
FIG. 2 is a front perspective view of the adjustable stationary bicycle of FIG. 1.
Figure 3:
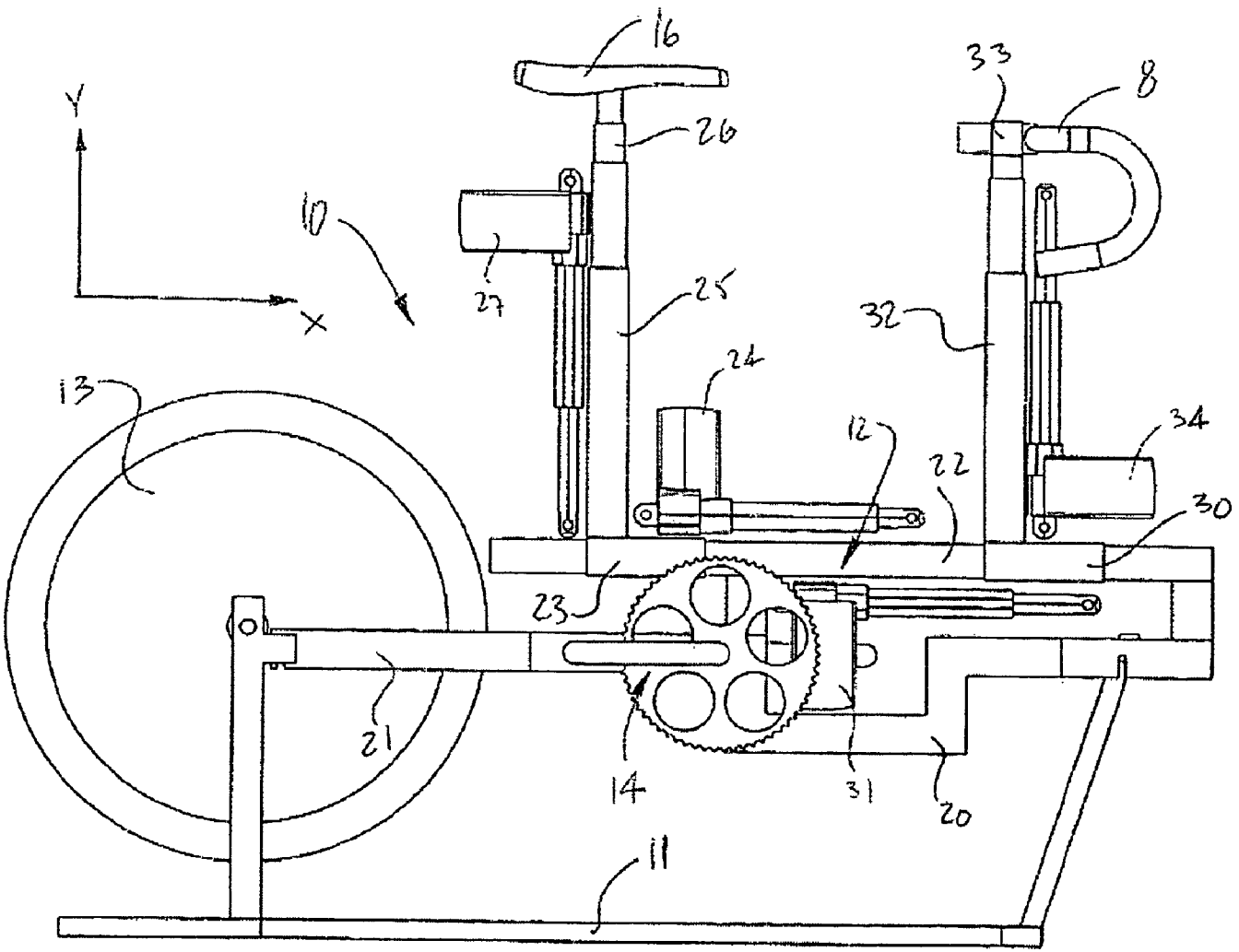
FIG. 3 is a side elevation view of the adjustable stationary bicycle of FIG. 1.

Referring now to the drawings and more particularly to FIGS. 1 to 3, an adjustable stationary bicycle in accordance with a first embodiment is generally shown at 10. The stationary bicycle 10 has a base 11, a frame 12, an exercise wheel 13, a crankset 14, a seat 16 and a handlebar 18.

The base 11 supports a remainder of the bicycle 10. The base 11 is for instance mounted on the floor.

A frame 12 is connected to the base 11. The frame 12 supports the various user interface components of the bicycle 10, namely the crankset 14, the seat 16 and the handlebar 18.

The exercise wheel 13 is related to the crankset 14. The power output of the user of the bicycle 10 is typically measured using the exercise wheel 13. The exercise wheel 13 is also actuated to control the resistance to pedaling.

The crankset 14 has pedals (not shown) and receives the pedaling actuation from the user of the bicycle 10.

The seat 16 supports the user of the bicycle 10 in a riding position.

The handlebar 18 is provided as a support for the arms of the user.

The frame 12 has a support beam 20 by which it is connected to the base 11. The support beam 20 has a chainstay 21 between which the exercise wheel 13 is in a rotational relation. Although not shown, a chain/chainring and gears, belt/pulleys or similar transmissions are provided between the wheel 13 and the crankset 14 for the transmission of the pedaling power of the user to the wheel 13.

A rail 22 is supported by the support beam 20. The rail 22 is generally parallel to the ground. A carriage 23 is slidingly mounted onto the support beam 20, so as to form a prismatic joint therewith (i.e., translational one-DOF joint). As it is supported by the carriage 23, the seat 16 is displaceable in translation along the X-axis. The prismatic joint formed by the rail 22 and the carriage 23 is actuated by actuator 24.

A seat tube 25 is connected to the carriage 23 and is preferably in a perpendicular relation therewith. A seat post support 26 is telescopically engaged into the seat tube 25, so as to form another prismatic joint. As the seat post of the seat 16 is locked to the seat post support 26, the seat 26 is displaceable in translation along the Y-axis. The prismatic joint formed by the seat tube 25 and the seat post support 26 is actuated by actuator 27.

The handlebar 18 is also displaceable in translation along the X-axis and the Y-axis. More specifically, a carriage 30 supporting the handlebar 18 is operatively mounted to a front end of the rail 22, thereby forming a prismatic joint. The direction of the carriage 30 is along the X-axis. In the illustrated embodiment, the displacement of the handlebar 18 along the X-axis is actuated by actuator 31.

A head tube 32 is mounted to the carriage 30, and is preferably in a perpendicular relation therewith. A bracket 33 is telescopically inserted into the head tube 32 so as to form a prismatic joint displaceable along the Y-axis direction. Actuator 34 powers the prismatic joint along the Y-axis direction.

Although the actuators 24, 27, 31 and 34 are preferably electrically powered linear actuators, it is contemplated to use manual actuation as well. The translational degrees of freedom of the seat 16 and of the handlebar 18 are mechanically controlled and self-supported/self-locked such that actuation is required to displace the seat 16 and/or handlebar 18. In the illustrated embodiments, the seat 16 and handlebar 18 are therefore fixed into X and Y positions, and can only be displaced by actuation of the prismatic joints. Therefore, the seat 16 and the handlebar 18 are displaceable even while a rider is supported in a riding position.

The bracket 33 is a quick-release mechanism allowing different handlebars 18 to be mounted rapidly onto the stationary bicycle 10. Alternatively, a handlebar extendable in a Z-axis (perpendicular to both the X- and Y-axes) is considered.

Although not shown, the crankset 14 is preferably of the extendable type, in that the cranks can be adjusted to different lengths. One contemplated crankset system has the cranks pivotally off-center from the chainring, so as to be adjustable to different crank lengths.

Various sensors are provided in order to measure the performance of the rider on the stationary bicycle 10. For instance, referring to FIG. 5, a power sensor 40 and a cadence sensor 41 are respectively provided in association with the exercise wheel 13 and the crankset 14 to measure the pedaling power and the cadence. Other configurations for these sensors, and for other sensors 42, are considered, such as a heart-rate monitor, pressure sensors for the pedals, etc.

Figure 4:
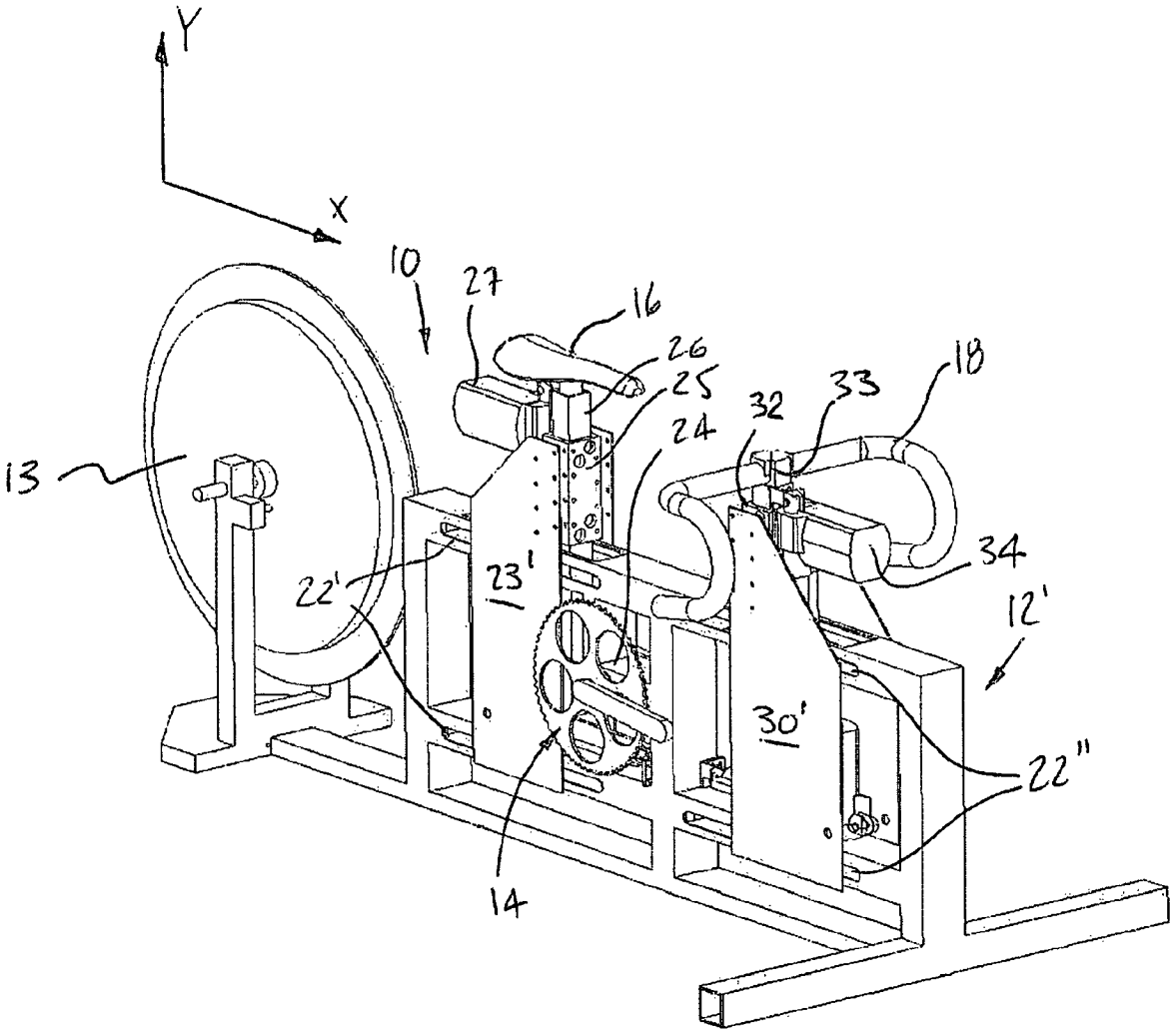
FIG. 4 is a front perspective view of an adjustable stationary bicycle in accordance with another embodiment of the present invention.

It is considered to have the stationary bicycle 10 take different configurations to enhance its stiffness. Referring to FIG. 4, an alternative embodiment of the stationary bicycle is also illustrated as 10, but features a frame 12' that is different than the frame 12 of the stationary bicycle of FIGS. 1 to 3. Many components are similar between the stationary bicycles 10 of FIGS. 1-3 and of FIG. 4, whereby like parts will bear like reference numerals.

The frame 12' has a pair of guideways 22' supporting the carriage 23', such that the carriage 23' is displaceable in translation along the X-axis, enabling the horizontal adjustment of the seat 16. The carriage 23' consists of a pair of parallel plates that support the seat tube 25.

Similarly, the frame 12' has a pair of guideways 22" supporting the carriage 30', such that the carriage 30' is displaceable in translation along the X-axis, enabling the horizontal adjustment of the seat 16. The carriage 30' consists of a pair of parallel plates that support the head tube 32.

The configuration of the frame 12' (FIG. 4), although similar in construction to the frame 12 (FIGS. 1-3), provides added structural rigidity to the stationary bicycle 10. Alternative frame configurations are considered as well.

Figure 5:
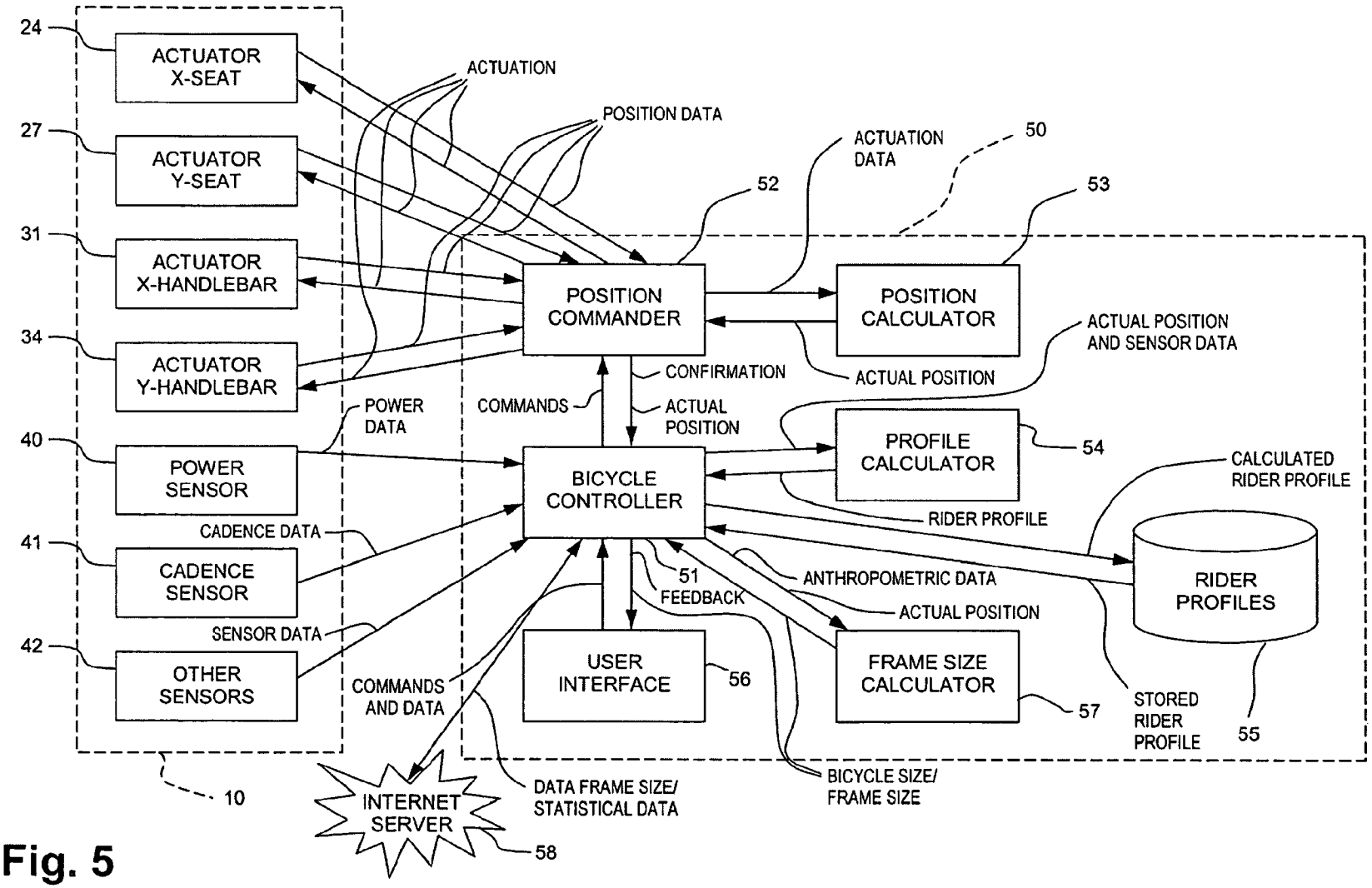
FIG. 5 is a block diagram of a bicycle controller system used in combination with the adjustable stationary bicycle of FIGS. 1 and 4.

Referring to FIG. 5, a stationary bicycle controller system in accordance with a preferred embodiment is generally shown at 50. The bicycle controller system 50 is in communication with the actuators 24, 27, 31 and 34, as well as with the sensors 40, 41 and 42.

The bicycle controller system 50 has a bicycle controller 51 that is a processing unit (PC, microprocessor, or the like). The bicycle controller 51 receives data from the power sensor 40, the cadence sensor 41 and the other sensors 42.

A position commander 52 is connected to the bicycle controller 51, and is in association with the actuators 24, 27, 31 and 34. More specifically, the actuation of the actuators 24, 27, 31 and 34 is controlled by the commander 52. A position calculator 53 is connected to the position commander 52 and determines the position of the seat 16 and the handlebar 18 in the X-Y coordinate system illustrated in FIGS. 1 to 3.

As an example, a reference point for the X and Y coordinates of the seat 16 and the handlebar 18 is a center of the crankset 14. Considering that the feet of the rider are locked to the cranks of the crankset 14, the center of the crankset 14 constitutes a fixed point well suited to be used as a reference for the position of the seat 16 and the handlebar 18.

The position calculator 53 may operate in different ways. For instance, a calibration is preferably performed every time the stationary bicycle 10 is turned on, so as to relate the degree of actuation of the actuators 24, 27, 31 and 34 to X and Y positions. In an embodiment, the actuators 24, 27, 31 and 34 are subjected to a homing movement (moved to a null extension) to be calibrated. Alternatively, sensors (not shown) may be provided in the actuators 24, 27, 31 and 34, or on the various prismatic joints, so as to detect the position of the seat 16 and the handlebar 18 with respect to the reference. The use of sensors is considered for manually actuated mechanisms of displacements for the seat 16 and the handlebar 18.

A profile calculator 54 is connected to the bicycle controller 51. The profile calculator 54 receives the various data from the sensors 40-42, as well as the X and Y positions of the seat 16 and the handlebar 18, as a function of time. Accordingly, the performance of the rider (pedaling power, cadence, heart rate) is related to the dimensions of the stationary bicycle 10. All information is related to rider identification and characteristics (e.g., name, anthropometric measurements, weight, age, etc.) in the form of a rider profile in a rider profile database 55. Additional information can be recorded under the rider profile, such as the preferred dimensions of the stationary bicycle 10.

A user interface 56 is connected to the bicycle controller 51. The user interface 56 is typically a monitor with touch keys or a keyboard, through which the user interface 56 is commanded and information is entered (e.g., rider identification). In an embodiment, the user interface 56 displays actuator controls, for the manual control of the actuation of the actuators 24, 27, 31 and 34. It is considered to provide a touch-screen with icons represent available directions of displacement for the seat 16 and the handlebar 18.

The user interface 56 may include other peripherals, such as a printer, ports for plug-in devices (e.g., USB port), digital camera, etc. Smart cards and chip cards can be used to store the rider profile.

Amongst the various applications considered, the use of the stationary bicycle 10 as a training device in a public gym setting is contemplated. When a rider wants to use the bicycle 10, his/her identification is entered into the bicycle controller system 50, whereby the rider profile is retrieved from the database 55. The bicycle controller 51 transmits the information to the position commander 52 such that the size of the stationary bicycle 10 is adjusted as a function of the rider identification.

For a new user of the stationary bicycle 10, a rider profile is created and saved in the rider profile database 55. It is considered to provide statistical data relating anthropometric data of users to desired bicycle dimensions. Accordingly, by entering anthropometric data pertaining to a user, the bicycle controller 51 can select a suitable bicycle size as a function of the anthropometric data. As described hereinafter, a frame size calculator 57 is used to select a suitable bicycle size from the anthropometric data. Alternatively, from statistical data, formulas can be derived to determine initial bicycle dimensions as a function of anthropometric data.

Moreover, the rider profile may include the performance of the rider at different bicycle dimensions. Therefore, an optimal bicycle size can be determined from the review of the information gathered in the database 55 following calculations by the profile calculator 54. This is particularly useful for elite athletes. Alternatively, a trainer can assist the rider in trying different bicycle sizes, to then enter the dimensions, at a position selected by the trainer or the rider.

As another application, the stationary bicycle 10 is used as a fitting apparatus to determine an optimal bicycle size. The stationary bicycle 10 is used with the controller system 50 to gather performance information associated with bicycle size. The use of actuators 24, 27, 31 and/or 34 enables a dynamic fitting. More specifically, the controller system 50 may direct a plurality of incremental changes to have the rider try various adjusted positions while not interrupting his/her pedaling. As an alternative, the rider profile data from the database 55 may then interpreted to identify the optimal position. With the rider profile, the optimal bicycle size (according to the type of bicycle, such as road bike, mountain bike, cyclo-cross bike, etc.) for the rider can be determined.

When the stationary bicycle 10 is used as part of a fitting apparatus, it is considered to provide the controller system 50 with the frame size calculator 57. The frame size calculator 57 receives the actual position data from the bicycle controller 51 (i.e., the adjusted position following testing by the user), and produces frame size data. The frame size calculator 57 is also provided to identify initial seat and handlebar positions from the anthropometric data of the user. The frame size calculator 57 typically selects starting seat and handlebar positions from statistical data relating bicycle size to anthropometric data. For this purpose, the bicycle controller 51 is connected to the internet 58, to access a remotely-located server comprising the statistical data tables associating bicycle/frame sizes to anthropometric data. These statistical data tables are typically updated with any new user recording adjusted bicycle dimensions as a function of anthropometric data.

The frame size data calculated by the frame size calculator 57 represents enough information for a user (e.g., salesman) to select a bicycle of correct size. As an example, the X and Y coordinates of the seat and of the handlebars are given with respect to the pivot axis of the crankset. A tool (e.g., a t-shaped ruler) may then be provided to measure a bicycle to determine whether it has the right size. Accordingly, a store salesman can readily pick bikes from the inventory by having the required dimensions of the bike, and means to measure the bike.

Alternatively, the user interface 56 may produce data in the form of savable files. For instance, the frame size data may be printed out, or saved, to be sent to a supplier or a manufacturer of bicycles. Similarly, the bicycle controller 51 may be connected to the internet 58, so as to forward bike dimensions to a manufacturer of bicycles. In the case of custom-made bicycles, the delay between the fitting of a bicycle is reduced with the use of the controller system 50.

Additional information can be obtained. For instance, it is considered to place the stationary bicycle 10 in a wind tunnel in order to obtain the rider's drag coefficient as a function of the effect of the size of the bicycle on the riding position. This information is then related to the performance of the rider to determine the optimal size of the bicycle for the rider.

It is also considered to use the stationary bicycle 10 as a motion simulator for video games. The stationary bicycle 10 can provide force feedback in the form of resistance in the exercise wheel 13, as well as through actuation of the actuators 24, 27, 31 and/or 34 to simulate the vibrations of a bicycle.

Figure 6:
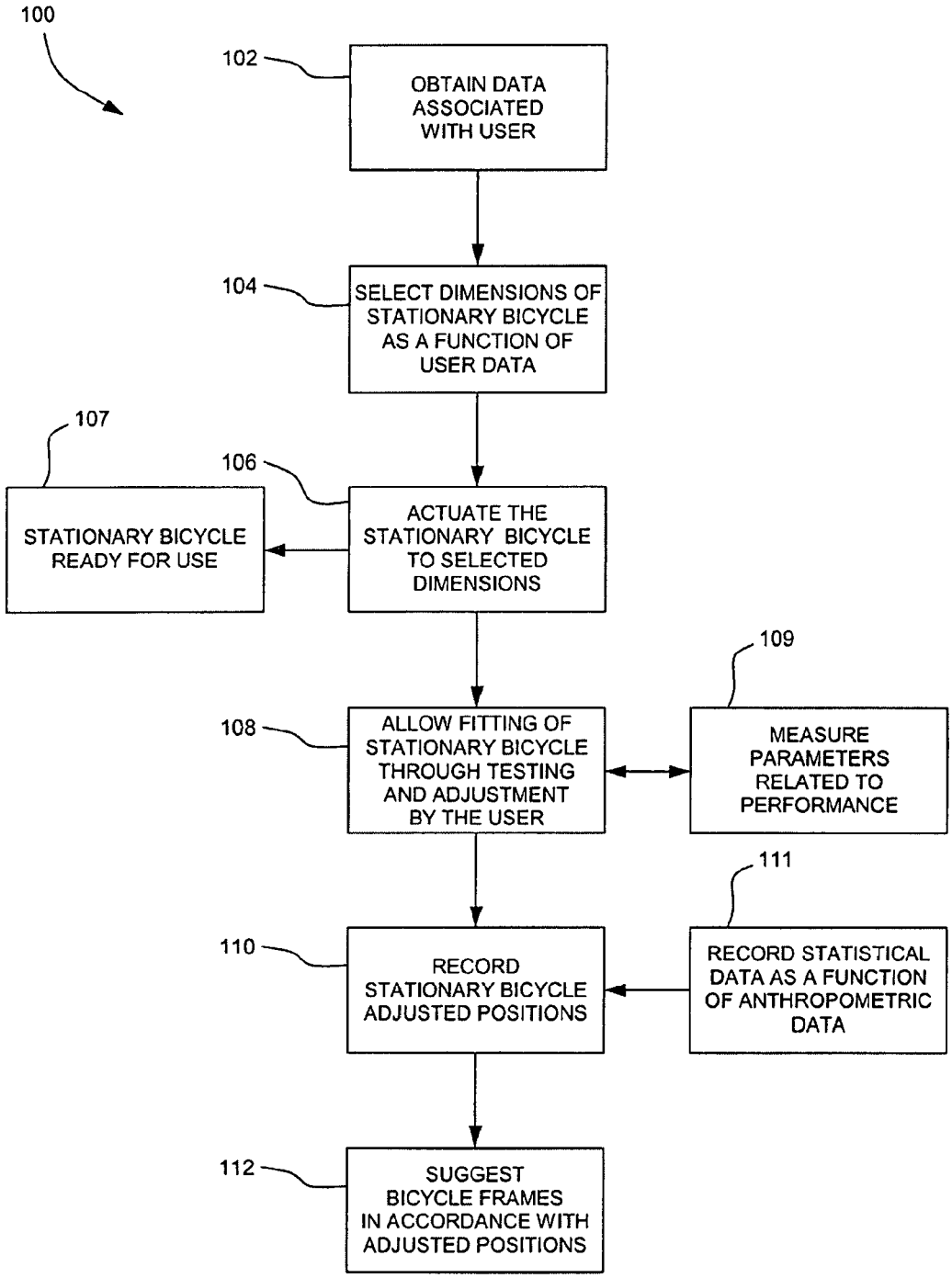
FIG. 6 is a flow chart illustrating a method for adjusting a stationary bicycle in accordance with yet another embodiment of the present invention.

In FIG. 6, a method for adjusting a stationary bicycle, such as the stationary bicycle 10 of FIGS. 1 to 4, for instance used in combination with the stationary bicycle control system as described in FIGS. 1 to 5, is explained.

In step 102, data associated with the user of the stationary bicycle is obtained.

In one embodiment, if it is the first time the user tries the stationary bicycle, the data is typically anthropometric data pertaining to the limb length (e.g., measured at the crotch), the torso dimensions, the arm length of the user, the shoulder width. Additional information such as user restrictions (e.g., back pain, knee problems, or the like) may also be recorded.

In another embodiment, in which the stationary bicycle is used in a training environment and the user already has a profile recorded in the stationary bicycle control system 50 (FIG. 5), the data obtained in step 102 is an identification of the user. By obtaining the identification of the user in step 102, the stationary bicycle control system 50 can load stationary bicycle dimensions as prerecorded in a user profile following a previous adjustment session.

In step 104, the dimensions of the stationary bicycle are selected as a function of the user data obtained in step 102. More specifically, if the data is anthropometric in nature, the stationary bicycle control system obtains typical dimensions from statistical data tables relating anthropometric data of numerous users to average dimensions associated with such data. In another embodiment, the selected dimensions of the stationary bicycle are provided with a user profile.

In step 106, the stationary bicycle is actuated to the selected dimensions using the various actuators described in FIGS. 1 to 5.

In step 107, particularly useful when the stationary bicycle is used in a training environment, the stationary bicycle is ready for use. Step 107 is typically achieved if an adjustment fitting of the stationary bicycle was performed in a previous session.

In step 108, a testing period is provided for the stationary bicycle. More specifically, the user spins with the stationary bicycle in order to provide a personal appreciation of the specific selected dimensions. In step 108, the user or an operator (e.g., a trainer) use the interface of the stationary bicycle control system 50 in order to adjust the seat and handlebar position, to reach adjusted positions that are preferred by the user. It is also pointed out that an observer, such as a bike-shop specialist, can stand next to the user to provide comments on the stance and the pedaling style.

In one testing configuration, the adjusted positions are reached after several positions are tested. It is suggested to provide incremental variations of the bicycle dimension, and require that the user spins at a constant power. The comments of the user are gathered at each variation of position, to facilitate the selection of a bicycle size. It is also considered to film the user while pedaling to provide footage of pedaling actuation for different frame dimensions.

In another testing configuration, the adjusted positions are used after gathering parameters related to the performance of the user. More specifically, in optional step 109, measurements are made on parameters related to the performance of the user of the stationary bicycle. For instance, the pedaling power, the pedaling cadence, and the heart rate of the user are measured as a function of the stationary-bicycle dimensions. This step is typically performed for high-level athletes.

In step 110, once testing is completed and the user has elected final dimensions for the stationary bicycle, the adjusted dimensions are recorded for the user. Accordingly, if the stationary bicycle is used in a training environment, a profile specific to the user are recorded, so as to skip testing steps 108 and 109 at the next use.

In optional step 111, statistical data is recorded as a function of the anthropometric data so as to accumulate general data associating bicycle dimensions with anthropometric data.

In step 112, particularly useful for bike-shop use, bicycle-frame dimensions are suggested in accordance with the adjusted positions recorded in step 110.

In one embodiment, the bicycle-frame dimensions may be compared with inventory of a shop so as to determine what bicycles in the shop are suited for the user as a function of the adjusted positions resulting from method 100.

As an alternative embodiment, the bicycle-frame dimensions obtained in step 112 are forwarded to a bicycle manufacturer for the manufacture of a bicycle with such dimensions.

The invention claimed is:

1. A stationary bicycle control system in combination with a stationary bicycle, comprising:

a stationary bicycle comprising a crankset rotatably mounted to a frame to receive a pedaling actuation from a user of the stationary bicycle, a seat and a handlebar, at least two 1-degree-of-freedom (1-DOF) seat joints between the frame and the seat, and at least two 1-DOF handlebar joints between the frame and the handlebar;

seat actuators electrically powered to actuate each of the at least two 1-DOF seat joints to cause displacement of the seat in vertical and horizontal directions with respect to the crankset;

handlebar actuators electrically powered to actuate each of the at least two 1-DOF handlebar joints to cause displacement of the handlebar in vertical and horizontal directions with respect to the crankset;

a bicycle controller system comprising:

a user interface for manually entering/adjusting positions for the seat and for the handlebar;

a position commander for displacing the seat and the handlebar through actuation of the seat actuator and the handlebar actuator; and a position calculator receiving actuation data from the position commander and calculating a position of the seat and of the handlebar so as to guide the position commander in positioning the seat and the handlebar to selected positions as manually entered in the user interface.

2. The stationary bicycle control system in combination with the stationary bicycle according to claim 1, wherein the bicycle controller system further comprises a profile calculator for recording a desired position for the seat and for the handlebar, the desired position being specific to a user.

3. The stationary bicycle control system in combination with the stationary bicycle according to claim 2, further comprising sensors to measure parameters associated with the user performing the pedaling actuation.

4. The stationary bicycle control system in combination with the stationary bicycle according to claim 3, wherein the profile calculator records said parameters as a function of positions of the seat and of the handlebar.

5. The stationary bicycle control system in combination with the stationary bicycle according to claim 4, wherein the parameters are at least one of a pedaling power, a pedaling cadence and a heart rate of the user.

6. The stationary bicycle control system in combination with the stationary bicycle according to claim 2, wherein the bicycle controller system has a frame size calculator for identifying suitable bicycle frames as a function of the desired position of the seat and of the handlebar.

7. The stationary bicycle control system in combination with the stationary bicycle according to claim 1, further comprising a profile database to store a profile of the user, the profile comprising at least a desired position for the seat and for the handlebar.

8. The stationary bicycle control system in combination with the stationary bicycle according to claim 1, further comprising a statistical database to store statistical data associating anthropometric data of users with desired position for the seat and for the handlebar.

9. The stationary bicycle control system in combination with the stationary bicycle according to claim 8, wherein the database is a remotely-located server.

10. A stationary bicycle control system in combination with a stationary bicycle, comprising:

a stationary bicycle comprising a crankset rotatably mounted to a frame to receive a pedaling actuation from a user of the stationary bicycle, a seat and a handlebar, at least one 1-degree-of-freedom (1-DOF) seat joint between the frame and the seat, and at least one 1-DOF handlebar joint between the frame and the handlebar;

a seat actuator electrically powered to actuate the 1-DOF seat joint to cause displacement of the seat;

a handlebar actuator electrically powered to actuate the 1-DOF handlebar joint to cause displacement of the handlebar;

a bicycle controller system comprising:

a user interface for manually entering/adjusting positions for the seat and for the handlebar;

a position commander for displacing the seat and the handlebar through actuation of the seat actuator and the handlebar actuator;

a position calculator receiving actuation data from the position commander and calculating a position of the seat and of the handlebar so as to guide the position commander in positioning the seat and the handlebar to selected positions as manually entered in the user interface; and a profile calculator for recording a desired position for the seat and for the handlebar, the desired position being specific to a user.

11. The stationary bicycle control system in combination with the stationary bicycle according to claim 10, further comprising sensors to measure parameters associated with the user performing the pedaling actuation.

12. The stationary bicycle control system in combination with the stationary bicycle according to claim 11, wherein the profile calculator records said parameters as a function of positions of the seat and of the handlebar.

13. The stationary bicycle control system in combination with the stationary bicycle according to claim 12, wherein the parameters are at least one of a pedaling power, a pedaling cadence and a heart rate of the user.

14. The stationary bicycle control system in combination with the stationary bicycle according to claim 10, further comprising a profile database to store a profile of the user, the profile comprising at least a desired position for the seat and for the handlebar.

15. The stationary bicycle control system in combination with the stationary bicycle according to claim 10, further comprising a statistical database to store statistical data associating anthropometric data of users with desired position for the seat and for the handlebar.

16. The stationary bicycle control system in combination with the stationary bicycle according to claim 15, wherein the database is a remotely-located server.

17. The stationary bicycle control system in combination with the stationary bicycle according to claim 10, wherein the bicycle controller system has a frame size calculator for identifying suitable bicycle frames as a function of the desired position of the seat and of the handlebar.

18. A stationary bicycle control system in combination with a stationary bicycle, comprising:

a stationary bicycle comprising a crankset rotatably mounted to a frame to receive a pedaling actuation from a user of the stationary bicycle, a seat and a handlebar, at least one 1-degree-of-freedom (1-DOF) seat joint between the frame and the seat, and at least one 1-DOF handlebar joint between the frame and the handlebar;

a seat actuator electrically powered to actuate the 1-DOF seat joint to cause displacement of the seat;

a handlebar actuator electrically powered to actuate the 1-DOF handlebar joint to cause displacement of the handlebar;

a bicycle controller system comprising:

a user interface for manually entering/adjusting positions for the seat and for the handlebar;

a position commander for displacing the seat and the handlebar through actuation of the seat actuator and the handlebar actuator;

a position calculator receiving actuation data from the position commander and calculating a position of the seat and of the handlebar so as to guide the position commander in positioning the seat and the handlebar to selected positions as manually entered in the user interface; and a profile database to store a profile of the user, the profile comprising at least a desired position for the seat and for the handlebar.

19. The stationary bicycle control system in combination with the stationary bicycle according to claim 18, further comprising a statistical database to store statistical data associating anthropometric data of users with desired position for the seat and for the handlebar.

20. The stationary bicycle control system in combination with the stationary bicycle according to claim 19, wherein the database is a remotely-located server.

21. The stationary bicycle control system in combination with the stationary bicycle according to claim 18, wherein the bicycle controller system has a frame size calculator for identifying suitable bicycle frames as a function of the desired position of the seat and of the handlebar.

22. A stationary bicycle control system in combination with a stationary bicycle, comprising:

a stationary bicycle comprising a crankset rotatably mounted to a frame to receive a pedaling actuation from a user of the stationary bicycle, a seat and a handlebar, at least one 1-degree-of-freedom (1-DOF) seat joint between the frame and the seat, and at least one 1-DOF handlebar joint between the frame and the handlebar;

a seat actuator electrically powered to actuate the 1-DOF seat joint to cause displacement of the seat;

a handlebar actuator electrically powered to actuate the 1-DOF handlebar joint to cause displacement of the handlebar;

a bicycle controller system comprising:

a user interface for manually entering/adjusting positions for the seat and for the handlebar;

a position commander for displacing the seat and the handlebar through actuation of the seat actuator and the handlebar actuator;

a position calculator receiving actuation data from the position commander and calculating a position of the seat and of the handlebar so as to guide the position commander in positioning the seat and the handlebar to selected positions as manually entered in the user interface; and a statistical database to store statistical data associating anthropometric data of users with desired position for the seat and for the handlebar.

23. The stationary bicycle control system in combination with the stationary bicycle according to claim 22, wherein the database is a remotely-located server.

24. The stationary bicycle control system in combination with the stationary bicycle according to claim 22, wherein the bicycle controller system has a frame size calculator for identifying suitable bicycle frames as a function of the desired position of the seat and of the handlebar.

* * * * *